US006647967B2

(12) United States Patent
Fukui et al.

(10) Patent No.: US 6,647,967 B2
(45) Date of Patent: Nov. 18, 2003

(54) FUEL INJECTION CONTROL DEVICE FOR INTERNAL COMBUSTION ENGINE

(75) Inventors: Wataru Fukui, Tokyo (JP); Tosiki Kurokawa, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/996,902

(22) Filed: Nov. 30, 2001

(65) Prior Publication Data

US 2003/0010323 A1 Jan. 16, 2003

(30) Foreign Application Priority Data

Jul. 10, 2001 (JP) ..... 2001-209435

(51) Int. Cl.[7] ..... F02M 51/00
(52) U.S. Cl. ..... 123/492; 123/493
(58) Field of Search ..... 123/492, 493, 123/478, 681, 682, 683, 684, 687

(56) References Cited

U.S. PATENT DOCUMENTS 4,494,512 A * 1/1985 Kishi et al. ..... 123/677
4,736,725 A * 4/1988 Iwaki et al. ..... 123/480
4,884,548 A * 12/1989 Sogawa ..... 123/492
5,050,564 A * 9/1991 Suzuki et al. ..... 123/492

FOREIGN PATENT DOCUMENTS

JP 5-36613 4/1983

* cited by examiner

*Primary Examiner*—Mahmoud Gimie
(74) *Attorney, Agent, or Firm*—Sughrue Mion, PLLC

(57) ABSTRACT

A fuel injection control device for an internal combustion engine is provided, which comprises: a rpm sensor for detecting an engine speed; an intake pressure sensor for detecting an intake pressure; a throttle sensor for detecting the throttle opening degree; a first basic fuel injection volume calculating device for calculating a first basic fuel injection volume according to a fuel volume calculated by using the engine speed and the intake pressure as parameters; a second basic fuel injection volume calculating device for calculating a second basic fuel injection volume according to a fuel volume calculated by using the engine speed and the throttle opening degree as parameters; and a ratio calculating device for performing arithmetic operations on the first basic fuel injection volume and the second basic fuel injection volume at a desired mixture ratio, and the ratio calculating device gradually changes the mixture ratio at regular time intervals.

8 Claims, 5 Drawing Sheets

FUEL INJECTION CONTROL DEVICE FOR INTERNAL COMBUSTION ENGINE

This application is based on Application No. 2001-209435, field in Japan on Jul. 10, 2001, the contents of which are hereby incorporated by reference.

BACKGROUND OF THE INVENTION

1. Field of the Invention

The present invention generally relates to a fuel injection control device for an internal combustion engine. More particularly, the present invention relates to an improvement in a fuel injection control device for an internal combustion engine employing a structure in which the basic fuel injection volume can be determined based upon the intake pressure and a structure in which the basic fuel injection volume can be determined based on the throttle opening degree, together.

2. Description of Related Art

In the case of a normal two-wheeled vehicle, when an internal combustion engine (engine) is operated in a steady-state, the fuel injection is performed according to the basic fuel injection volume (hereinafter referred to as first basic fuel injection volume) based on the intake pressure and the engine speed. When the engine lies in a transient state, i.e. when the engine speed rapidly rises, however, the fuel injection is preferably performed according to the basic fuel injection volume (hereinafter referred to as second basic fuel injection volume) based on the throttle opening degree and the engine speed. Therefore, when the steady operation mode shifts to the transient operation mode, the fuel injection volume is usually switched between the first basic fuel injection volume and the second basic fuel injection volume according to a complement rate that is set in advance according to the engine speed and the throttle opening degree.

FIG. 4 is a block diagram showing the structure of a conventional fuel injection control device for an internal combustion engine. In FIG. 4, reference numeral 1 denotes a crank angle sensor for detecting the angle of a crank; 2, an intake pressure sensor for detecting the intake pressure of the air taken into an intake pipe; 3, a throttle sensor for detecting the throttle opening degree; 4, a variety of sensors for detecting data required for calculating an ignition timing.

Further, reference numeral 5 denotes a waveform shaping circuit for shaping a waveform of a detection signal S1 from the crank angle sensor 1; 6, a revolution speed calculating means for calculating an engine speed according to an output S5 from the waveform shaping circuit 5; 7, a first basic fuel injection volume calculating means for calculating a basic fuel injection volume according to the fuel volume calculated by using the engine speed and the intake pressure as parameters; 8, a second basic fuel injection volume calculating means for calculating a basic fuel injection volume according to a fuel volume calculated by using the engine speed and the throttle opening degree as parameters; 9, an injection volume switching section for switching the injection volume to the injection volume calculated by the first basic fuel injection calculating means or the injection volume calculated by the second basic fuel injection volume calculating means; 10, an ignition timing calculating means; 11, a CPU of the fuel injection control device, which includes the revolution speed calculating means 6, the first basic fuel injection volume calculating means 7, the second basic fuel injection volume calculating means 8, the injection volume switching section 9, and the ignition timing calculating means 10.

Reference numeral 12 denotes an injector drive circuit for causing injectors to inject fuel according to outputs from the injection volume calculating means 7 and 8 switched by the injection volume switching section 9, and reference numeral 13 denotes an ignition drive circuit for driving IG coils according to an output from the ignition timing calculating means.

Further, reference numerals 21 to 23 denote injectors, and reference numerals 31 to 33 denote IG coils.

FIG. 5 is a flow chart showing the operations for switching the injection volume between the injection volume calculated by the basic fuel injection volume calculating means 7 and the injection volume calculated by the basic fuel injection volume calculating means 8 in the fuel injection control device that is constructed in the above-mentioned manner.

Referring to FIG. 5, the throttle sensor 3 detects the throttle opening degree TH and outputs the detected value to the injection volume switching section 9 in the CPU 11 at a step 51.

At a step 52, the injection volume switching section 9 compares the throttle opening degree TH outputted from the throttle sensor 3 with a predetermined threshold. If the throttle opening degree TH is smaller than the threshold, the injection volume switching section 9 is switched so as to drive the injectors 21 to 23 according to the basic fuel injection volume that is calculated based on the engine speed and the intake pressure by the first basic fuel injection volume calculating means 7.

On the other hand, if the throttle opening degree TH is equal to or larger than the threshold, the injection volume switching section 9 is switched so as to drive the injectors 21 to 23 according to the basic fuel injection volume that is calculated based on the engine speed and the intake pressure signal by the second basic fuel injection volume calculating means 8.

As stated above, the conventional fuel injection control device for the internal combustion engine instantaneously switches the basic fuel injection volume between the two fuel injection volumes. For this reason, if the first basic fuel injection volume based on the intake pressure and the engine speed does not coincide with the second basic fuel injection volume based on the throttle opening degree and the engine speed when the basic fuel injection volume is switched, the calculated center of gravity fluctuates due to a variation in the engine speed or the load. This results in unstable feeling during the driving of a vehicle.

SUMMARY OF THE INVENTION

The present invention has been made to solve the above-mentioned problem, and it is therefore an object of the present invention to provide a fuel injection control device for an internal combustion engine that enables satisfactory combustion by switching the basic fuel injection volume between the basic fuel injection volume based on the intake pressure and the engine speed and the basic fuel injection volume based on the throttle opening degree and the engine speed in a preferable manner.

According to the present invention, there is provided a fuel injection control device for an internal combustion engine comprising: a crank angle sensor for detecting a revolution cycle of a crank shaft; an intake pressure sensor for detecting an intake pressure of air taken into an intake pipe; a throttle sensor for detecting a throttle opening degree of the intake pipe; rpm calculating means for calculating a rpm of the crank angle according to the revolution cycle of the crank shaft detected by the crank angle sensor; first basic fuel injection volume calculating means for calculating a first basic fuel injection volume by using the rpm and the intake pressure as parameters; second basic fuel injection volume calculating means for calculating a second basic fuel injection volume by using the rpm and the throttle opening degree as parameters; ratio calculating means for calculating a mixture ratio between the first basic fuel injection volume and the second basic fuel injection volume when a fuel injection volume is switched between the first basic fuel injection volume and the second basic fuel injection volume, and for gradually changing the mixture ratio at regular time intervals; and injector drive means for driving injectors so as to achieve an injection volume calculated by the ratio calculating means.

In the above-mentioned device, the ratio calculating means calculates the mixture ratio according to the operating conditions of the internal combustion engine.

In the above-mentioned device, the ratio calculating means regards the operating conditions of the internal combustion engine as at least a rpm of the internal combustion engine.

In the above-mentioned device, the ratio calculating means regards the operating conditions of the internal combustion engine as at least a temporal deviation in a rpm of the internal combustion engine.

In the above-mentioned device, the ratio calculating means regards the operating conditions of the internal combustion engine as at least information on a temperature of the internal combustion engine.

In the above-mentioned device, the ratio calculating means regards the operating conditions of the internal combustion engine as at least information on a gear position of a transmission in the internal combustion engine.

In the above-mentioned device, the ratio calculating means regards the operating conditions of the internal combustion engine as at least a throttle opening degree of the internal combustion engine.

In the above-mentioned device, the ratio calculating means regards the operating conditions of the internal combustion engine as at least a temporal deviation in a throttle opening degree of the internal combustion engine.

BRIEF DESCRIPTION OF THE DRAWINGS

The nature of the present invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS (Embodiment 1)

Embodiment 1 of the present invention will now be described with reference to the accompanying drawings.

Figure 1:
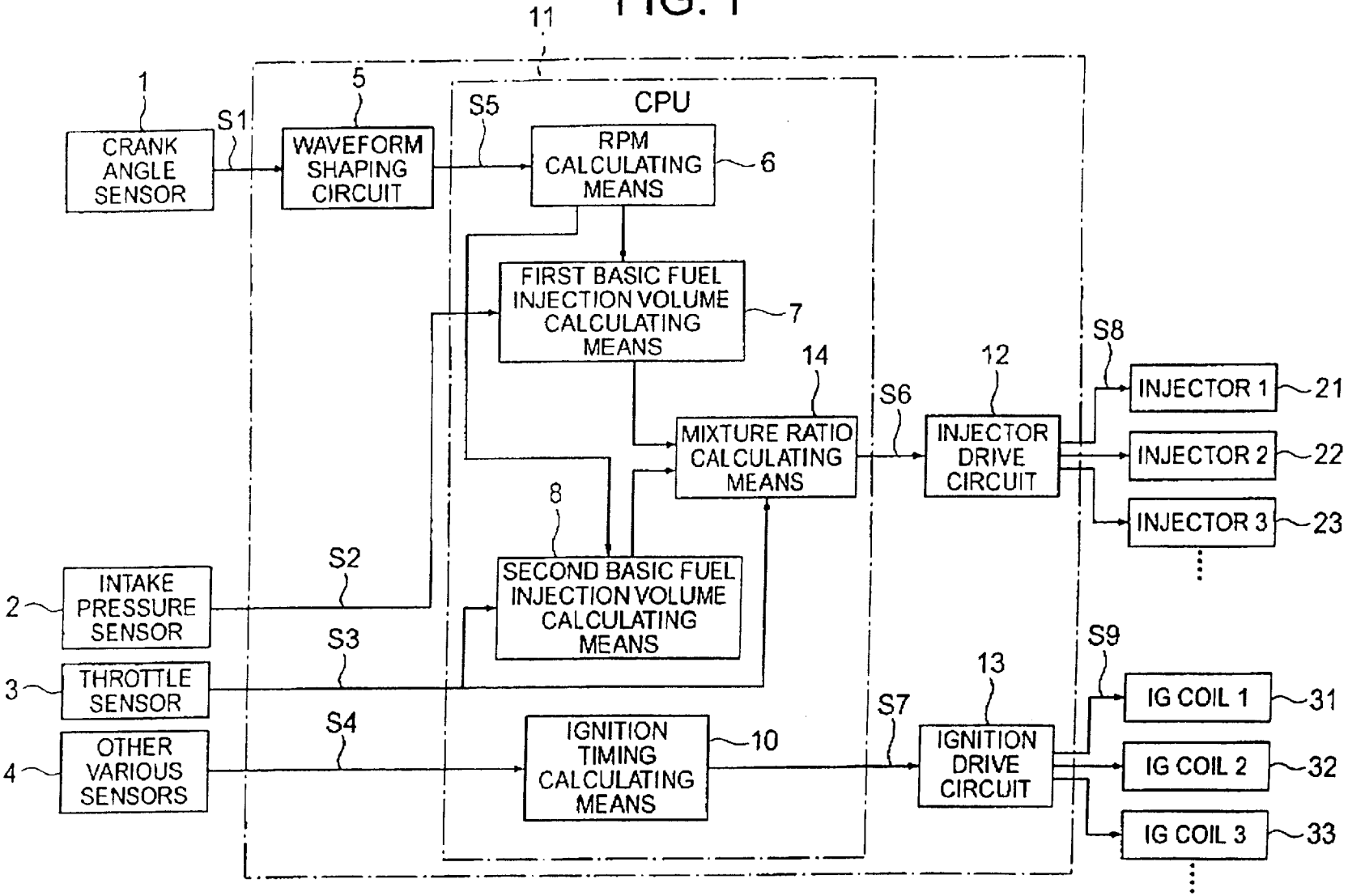
FIG. 1 is a block diagram showing the whole structure of a fuel injection control device for an internal combustion engine according to Embodiment 1 of the present invention.
Figure 4:
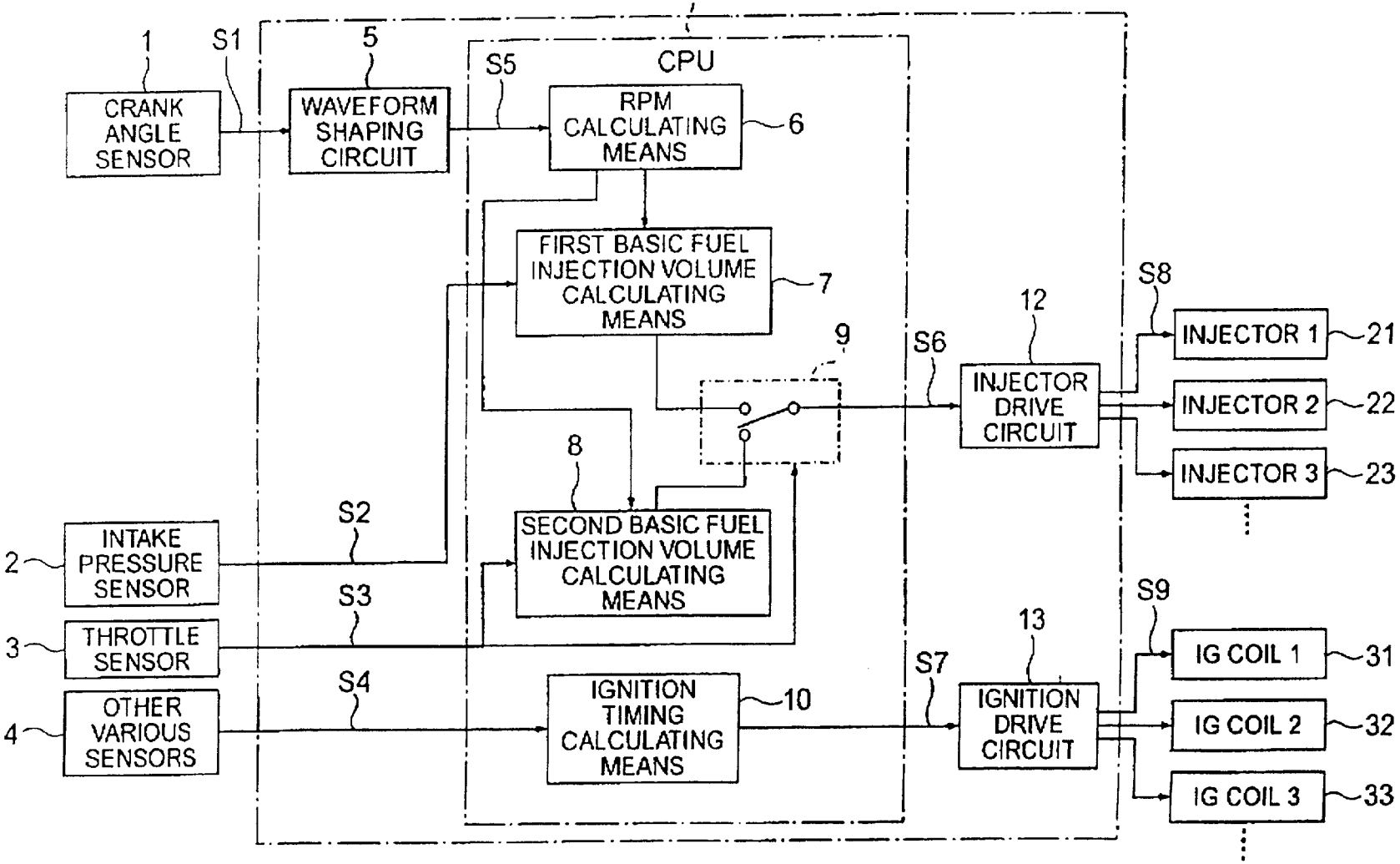
FIG. 4 PRIOR ART
FIG. 4 is a block diagram showing the whole structure of the conventional fuel injection control device for the internal combustion engine.
Figure 5:
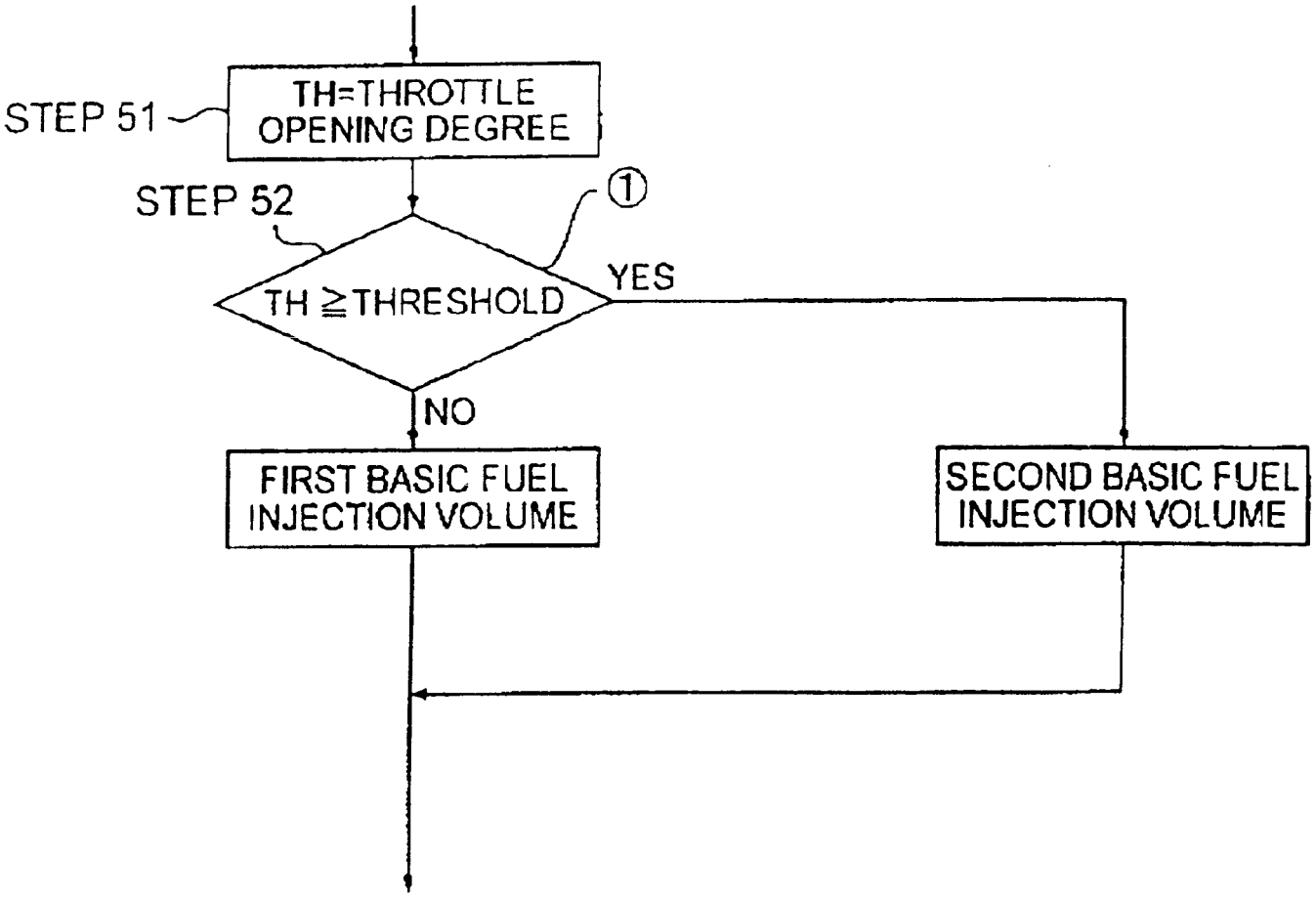
FIG. 5 PRIOR ART
FIG. 5 is a flow chart showing the operations for specifying the fuel injection volume of the conventional fuel injection control device for the internal combustion engine.

FIG. 1 is a block diagram showing the structure of a fuel injection control device for an internal combustion engine according to Embodiment 1 of the present invention. Parts similar to those described in FIG. 4 are denoted by the same reference numerals, and the description thereof is omitted here. In FIG. 1, reference numeral 14 denotes a mixture ratio calculating means for calculating the mixture ratio between the first basic fuel injection volume and the second basic fuel injection volume according to outputs from both a first basic fuel injection volume calculating means 7 and a second basic fuel injection volume calculating means 8.

The mixture ratio calculating means 14 sets a switching coefficient $\alpha$ with respect to the second basic fuel injection volume when the first basic fuel injection volume $T_{DJ}$ switches to the second basic fuel injection volume $T_{AN}$, and calculates the basic fuel injection volume $T_{PW}$ at the time of switching by the following equation (1):

$$T_{PW}=T_{DJ}\times(1-\alpha)+T_{AN}\times\alpha \quad (1)$$

By changing the switching coefficient $\alpha$ from 0 to 1 in the above equation (1), the first basic fuel injection volume $T_{DJ}$ can be switched to the second basic fuel injection volume $T_{AN}$.

Figure 2:
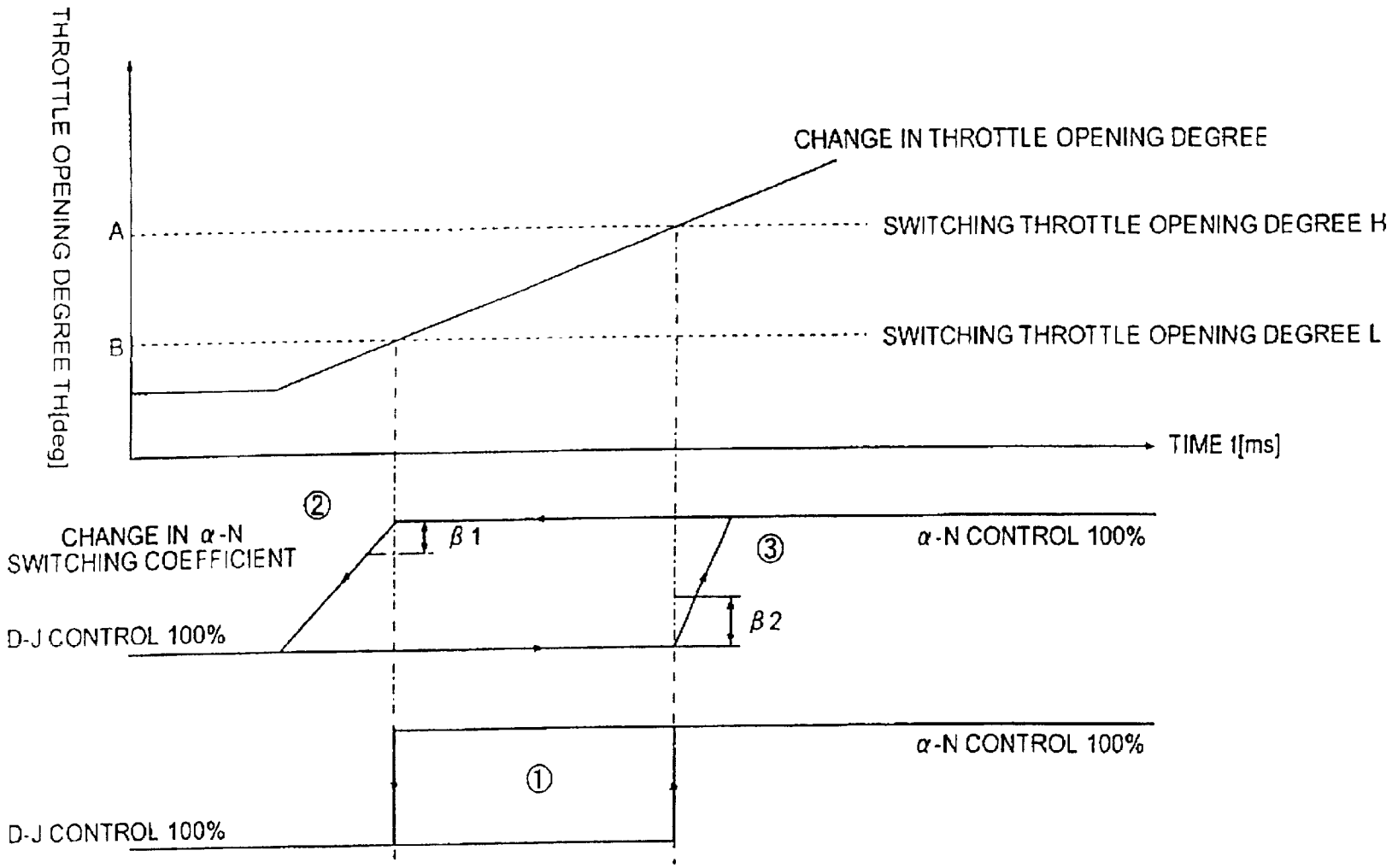
FIG. 2 is a time chart showing a comparison in a change in the fuel injection volume between the fuel injection control device according to Embodiment 1 of the present invention and a conventional fuel injection control device for an internal combustion engine.

Referring next to a time chart of FIG. 2, there is described a comparison in a change in the fuel injection volume between the fuel injection control device according to Embodiment 1 and a conventional fuel injection control device for an internal combustion engine.

When the throttle opening degree TH becomes equal to or larger than a predetermined switching throttle opening degree A, the switching coefficient $\alpha$ in the above equation (1) is gradually changed from 0 to 1 at regular time intervals (indicated by reference numeral 3 in FIG. 2). When the switching coefficient $\alpha$ becomes equal to 1, the first basic fuel injection volume $T_{DJ}$ switches to the second basic fuel injection volume $T_{AN}$ by one hundred percent. On the other hand, when the throttle opening degree TH becomes smaller than a predetermined switching throttle opening degree B (A<B), the switching coefficient α is gradually changed from 1 to 0 at regular time intervals (indicated by 2 in FIG. 2). When the switching coefficient α becomes equal to 0, the second basic fuel injection volume $T_{AN}$ switches to the first basic fuel injection volume $T_{DJ}$ by one hundred percent.

It should be noted that, in FIG. 2, "β1" represents a variation per unit time in the switching coefficient α when the first basic fuel injection volume $T_{AN}$ switches to the second basic fuel injection volume $T_{DJ}$, and "β2" in FIG. 2 represents a variation per unit time in the switching coefficient α when the second basic fuel injection volume $T_{DJ}$ switches to the first basic fuel injection volume $T_{AN}$. "β1" and "β2" may be determined arbitrarily.

The time chart indicated by reference numeral 1 in FIG. 2 shows a change in the fuel injection volume of the conventional fuel control device compared with the fuel injection control device according to Embodiment 1.

Figure 3:
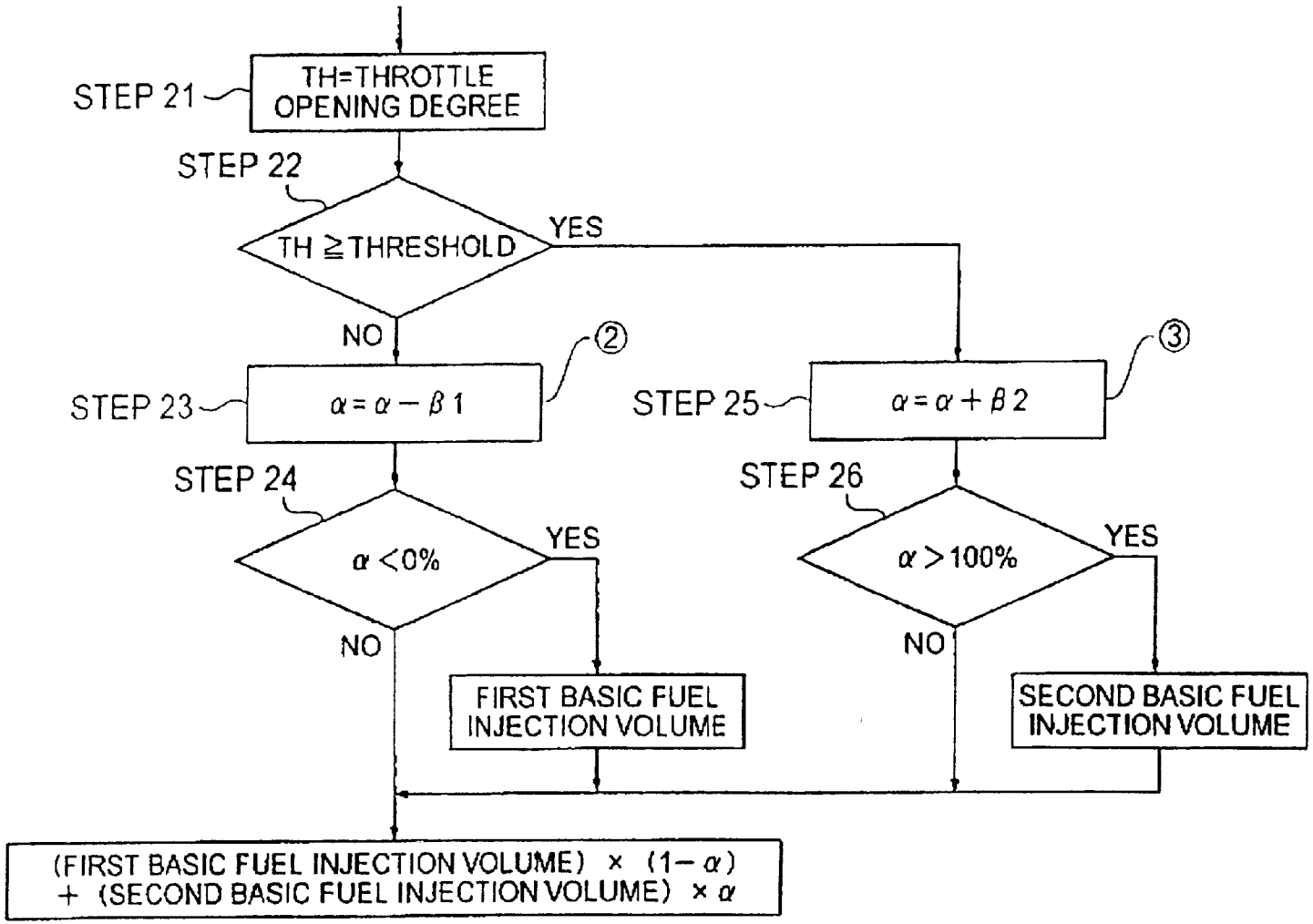
FIG. 3 is a flow chart showing the operations for specifying the fuel injection volume of the fuel injection control device for the internal combustion engine according to Embodiment 1 of the present invention.

Next, FIG. 3 is a flow chart showing the operations for switching the basic fuel injection volume between the injection volume calculated by the first basic fuel injection volume calculating means 7 and the injection volume calculated by the second basic fuel injection volume calculating means 8 by the mixture ratio calculating means 14.

First, at a step S21, a throttle sensor 3 detects the throttle opening degree TH and outputs it to the mixture ratio calculating means 14 in a CPU 11.

In the next step S22, the mixture ratio calculating means 14 compares the throttle opening degree TH outputted from the throttle sensor 3 with a predetermined threshold. It the throttle opening degree TH is smaller than the threshold, the operation proceeds to a step 23 where the variation β1 per unit time is subtracted from the switching coefficient α.

It is then determined whether the switching coefficient α found by the subtraction at the step S23 is smaller than 0% or not in a step S24. If the switching coefficient α is smaller than 0%, the first basic fuel injection volume is set as the basic fuel injection volume. If the switching coefficient α is equal to or larger than 0%, the basic fuel injection volume $T_{PW}$ is calculated based upon this switching coefficient α by the above equation (1).

On the other hand, if it is determined at the step S22 that the throttle opening degree TH is equal to or larger than the threshold, the operation proceeds to a step 25 where the variation β2 per unit time is added to the switching coefficient α. It is then determined whether the switching coefficient α found by the addition at the step S25 is larger than 100% or not. If the switching coefficient α is larger than 100%, the second basic fuel injection volume is set as the basic fuel injection volume. If the switching coefficient α is equal to or smaller than 100%, the basic fuel injection volume $T_{PW}$ is calculated based upon this switching coefficient α by the above equation (1).

According to Embodiment 1 described above, an injector is driven according to the basic fuel injection volume $T_{PW}$, and this achieves smooth feeling when the first basic fuel injection volume based on the intake pressure and the engine speed switches to the second basic fuel injection volume based on the throttle opening degree and the engine speed, and when the second basic fuel injection volume based on the throttle opening degree and the engine speed switches to the first basic fuel injection volume based on the intake pressure and the engine speed.

(Embodiment 2)

Embodiment 2 of the present invention will now be described.

According to the above-described Embodiment 1, the mixture ratio calculating means 14 adds or subtracts the variations β1, β2 per unit time depending on the throttle opening degree TH to or from the switching coefficient α to thereby change the fuel injection volume mixture ratio at regular time intervals.

The predetermined mixture variables β1, β2 should not necessarily depend on the throttle opening degree TH. For example, they may depend on a temporal deviation in the throttle opening degree TH. In this case, the throttle opening degree TH is detected at intervals of five seconds, and the throttle opening degree TH in the flow chart of FIG. 3 showing the switching operation of Embodiment 1 is replaced by the result obtained by calculating a variation in the meantime, so that the fuel injection volume mixture ratio can be changed according to the temporal deviation in the throttle angel TH at regular time intervals.

Likewise, the fuel injection volume mixture ratio may be changed at regular time intervals according to values detected by a variety of corresponding sensors: e.g., the rpm of the internal combustion engine based on a detected value from the crank angle sensor, a temporal deviation in the rpm, temperature information on the internal combustion engine, and a gear position of a transmission. Therefore, the same effect as that in Embodiment 1 can be obtained.

As set forth hereinabove, the fuel injection control device for the internal combustion engine according to the present invention achieves the smooth feeling when the first basic fuel injection volume based on the intake pressure and the engine speed switches to the second basic fuel injection volume based on the throttle opening degree and the engine speed and when the second basic fuel injection volume based on the throttle opening degree and the engine speed switches to the first basic fuel injection volume based on the intake pressure and the engine speed, thus enabling satisfactory combustion.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A fuel injection control device for an internal combustion engine, comprising:

a crank angle sensor for detecting a revolution cycle of a crank shaft;

an intake pressure sensor for detecting an intake pressure of air taken into an intake pipe;

a throttle sensor for detecting a throttle opening degree of the intake pipe;

rpm calculating means for calculating a rpm of the crank shaft according to the revolution cycle of the crank angle detected by said crank angle sensor;

first basic fuel injection volume calculating means for calculating a first basic fuel injection volume by using the rpm and the intake pressure as parameters;

second basic fuel injection volume calculating means for calculating a second basic fuel injection volume by using the rpm and the throttle opening degree as parameters;

ratio calculating means for calculating a mixture ratio between the first basic fuel injection volume and the second basic fuel injection volume when a fuel injection volume is switched between the first basic fuel injection volume and the second basic fuel injection volume, and for gradually changing the mixture ratio at regular time intervals; and injector drive means for driving injectors so as to achieve an injection volume calculated by said ratio calculating means.

2. A fuel injection control device for an internal combustion engine according to claim 1, wherein said ratio calculating means calculates the mixture ratio according to an operating conditions of the internal combustion engine.

3. A fuel injection control device for an internal combustion engine according to claim 2, wherein said ratio calculating means regards the operating conditions of the internal combustion engine as at least a rpm of the internal combustion engine.

4. A fuel injection control device for an internal combustion engine according to claim 2, wherein said ratio calculating means regards the operating conditions of the internal combustion engine as at least a temporal deviation in a rpm of the internal combustion engine.

5. A fuel injection control device for an internal combustion engine according to claim 2, wherein said ratio calculating means regards the operating conditions of the internal combustion engine as at least information on a temperature of the internal combustion engine.

6. A fuel injection control device for an internal combustion engine according to claim 2, wherein said ratio calculating means regards the operating conditions of the internal combustion engine as at least information on a gear position of a transmission in the internal combustion engine.

7. A fuel injection control device for an internal combustion engine according to claim 2, wherein said ratio calculating means regards the operating conditions of the internal combustion engine as at least a throttle opening degree of the internal combustion engine.

8. A fuel injection control device for an internal combustion engine according to claim 2, wherein said ratio calculating means regards the operating conditions of the internal combustion engine as at least a temporal deviation in a throttle opening degree of the internal combustion engine.

* * * * *